US008955702B2

(12) United States Patent
Wagner

(10) Patent No.: US 8,955,702 B2
(45) Date of Patent: Feb. 17, 2015

(54) LUFFING-JIB TOWER CRANE WITH JIB ANGLE ERROR CONTROL

(75) Inventor: Andreas Wagner, Talheim (DE)

(73) Assignee: Wolffkran Holding AG, Zug (CH)

( * ) Notice: Subject to any disclaimer, the term of this patent is extended or adjusted under 35 U.S.C. 154(b) by 245 days.

(21) Appl. No.: 13/578,951

(22) PCT Filed: Feb. 16, 2011

(86) PCT No.: PCT/EP2011/000742

§ 371 (c)(1),
(2), (4) Date: Nov. 27, 2012

(87) PCT Pub. No.: WO2011/101133

PCT Pub. Date: Aug. 25, 2011

(65) Prior Publication Data

US 2013/0062301 A1 Mar. 14, 2013

(30) Foreign Application Priority Data

Feb. 16, 2010 (DE) ..... 10 2010 008 155

(51) Int. Cl.
*B66C 13/16* (2006.01)
*B66C 23/88* (2006.01)
*B66C 23/82* (2006.01)

(52) U.S. Cl.
CPC ..... *B66C 23/88* (2013.01); *B66C 23/82* (2013.01)
USPC ..... 212/276; 212/280

(58) Field of Classification Search
None
See application file for complete search history.

(56) References Cited

U.S. PATENT DOCUMENTS

| | | | | |
|---|---|---|---|---|
| 3,740,534 | A | 6/1973 | Kezer et al. | |
| 3,833,130 | A * | 9/1974 | Gerdes et al. | 212/278 |
| 4,029,213 | A * | 6/1977 | Thompson et al. | 212/278 |
| 4,535,900 | A * | 8/1985 | Daniell | 212/310 |
| 4,752,012 | A | 6/1988 | Juergens | |
| 7,367,464 | B1 * | 5/2008 | Agostini et al. | 212/308 |
| 2006/0016775 | A1 * | 1/2006 | Willim | 212/347 |
| 2007/0017889 | A1 * | 1/2007 | Schobesberger | 212/308 |

FOREIGN PATENT DOCUMENTS

| | | | |
|---|---|---|---|
| DE | 22 25 153 | A1 | 12/1972 |
| DE | 101 27 403 | A1 | 12/2002 |
| EP | 1 031 531 | A2 | 8/2000 |
| GB | 2 012 719 | A | 8/1979 |

OTHER PUBLICATIONS

International Search Report issued in application No. PCT/EP2011/000742 on May 20, 2011.

* cited by examiner

*Primary Examiner* — Sang Kim
*Assistant Examiner* — Nathaniel Adams
(74) *Attorney, Agent, or Firm* — Foley & Lardner LLP

(57) ABSTRACT

A luffing-jib tower crane, comprising a tower and a jib which is connected to the tower via a joint and is held by a luffing cable, wherein the length of the luffing cable can be changed by a drawing-in unit, by the luffing cable being wound onto or unwound from a cable drum of the drawing-in unit, wherein the angle of the jib with respect to the horizontal plane is measured by a first sensor winch is attached to the jib (first angular value), wherein a measuring device measures the length of the unwound part of the luffing cable, from which length the minimum angle of the jib with respect to the horizontal plane (second angular value) can be calculated, and the first angular value can be compared with the second angular value.

6 Claims, 1 Drawing Sheet

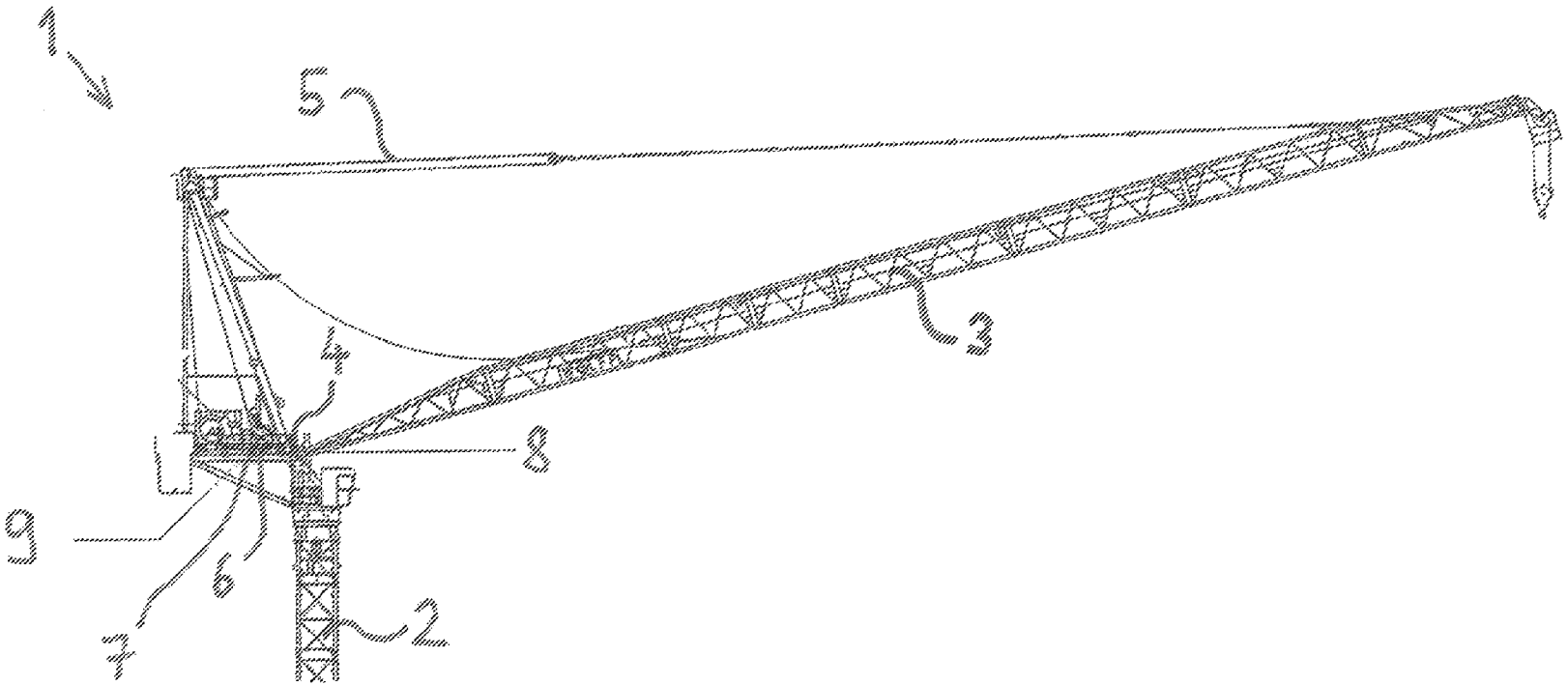
1
5
3
4
8
6
2
4
9

LUFFING-JIB TOWER CRANE WITH JIB ANGLE ERROR CONTROL

The invention relates to a luffing-jib tower crane, in which the jib is held by a luffing cable.

Tower cranes comprise a crane base, from which a tower extends upward. A jib and possibly a counter jib are attached to an upper section of the tower. In the case of luffing-jib tower cranes, a jib is connected to the tower via a joint, and therefore the angle of the jib with respect to the horizontal plane is changeable. In the case of the design of luffing-jib tower cranes, to which the present invention refers, the jib is held by a luffing cable, the length of which can be changed by the luffing cable being wound onto or unwound from a cable drum of a drawing-in unit.

BRIEF SUMMARY OF THE INVENTION

In the case of luffing-jib tower cranes, it is known to measure the angles of the jib in relation to the horizontal plane (jib angles) by a sensor attached to the jib. The functioning of such a sensor may consist, for example, in that a pendulum which hangs vertically downward because of gravity acts on a variable electric resistor, the resistance value of which is converted into the jib angle by means of electronic data processing.

The current jib angle measured can be used to calculate the current projection of the load for the particular crane. The determination of the projection is of significance in particular because the mathematical product of projection and load may not exceed a maximum value which is specific for the particular crane, since otherwise there is the risk of the crane falling over.

In the case of known luffing-jib rotary tower cranes, there is the risk of wind blowing so strongly and in such a direction against the jib that the force caused by the wind and pressing the jib in the direction of the tower (inward) is greater than the gravity component which pulls the jib away from the tower (outward). If, in such a situation, the luffing cable is extended, by being unwound from the cable drum of the drawing-in unit, the jib does not move outward, i.e. the jib angle is not reduced. The cable is slackened. When the wind drops at a later point, the jib may fall outward until the tightening luffing cable abruptly secures the jib. The resultant shaking may result in serious damage and accidents.

Furthermore, in the case of known luffing-jib tower cranes, there is the risk, despite the described measurement of the jib angle by means of a sensor attached to the jib, that the maximum value for the product of projection and load will be exceeded if the measurement of the jib angle is defective because of an apparatus error.

The invention is based on the object of providing a luffing-jib tower crane, in which the described risks are avoided.

This object is achieved by a luffing-jib tower crane with the features referred to in patent claim 1. Further embodiments are the subject matter of the dependent claims or are described below.

According to an embodiment, a luffing-jib tower crane comprises a tower and a jib which is connected to the tower via a joint and is held by a luffing cable, wherein the length of the luffing cable can be changed by a drawing-in unit by the luffing cable being wound onto or unwound from a cable drum of the drawing-in unit, wherein the angle of the jib with respect to the horizontal plane is measured by a first sensor attached to the jib (first angle value), characterized in that a measuring device measures the length of the unwound part of the luffing cable, from which length the minimum angle of the jib with respect to the horizontal plane (second angle value) can be calculated, and the first angle value can be compared with the second angle value.

According to an embodiment, the measuring device of the luffing-jib tower crane has a second sensor which measures the rotation of the cable drum of the drawing-in unit during the unwinding and winding operations.

In the above-described embodiments, the luffing-jib tower crane may further be characterized in that when the first angle value deviates from the second angle value, (1) the drive of the drawing-in unit is switched off, or (2) the luffing cable is wound up until the second angle value coincides with the first angle value.

BRIEF DESCRIPTION OF THE DRAWING(S)

FIG. 1 depicts a luffing jib tower crane according to an embodiment.

DETAILED DESCRIPTION

The measurement according to the invention of the length of the unwound part of the luffing cable permits the calculation of a second angle value which corresponds to the minimum angle of the jib with respect to the horizontal plane at a certain length of the luffing cable. This is because the actual angle of the jib, given corresponding winds which press the jib inward (upward), may possibly be larger than said second angle value. The comparison of the two angle values permits deviations to be established. In the same manner as the angle values may be determined continuously, the angle values may also be compared continuously. If a deviation is established, there is inevitably a malfunction which has to be eliminated. For example, the sensor attached to the jib may be defective or other components required for determining the two angle values may be defective. If the first angle value is greater than the second angle value, another possible cause is that the cable has slackened due to high wind. The determination of the first angle value is completely independent of the determination of the second angle value, and therefore malfunctions in the components which are required for determining the one angle value cannot have an effect on the determination of the other angle value.

In the embodiment shown in FIG. 1, a luffing jib tower crane 1 comprises a tower 2 and a jib 3 which is connected to the tower 2 via a joint 4 and is held by a luffing cable 5. The length of the luffing cable 5 can be changed by a drawing-in unit 6 by the luffing cable 5 being wound onto or unwound from a cable drum 7 of the drawing-in unit 6, wherein the angle of the jib 3 with respect to the horizontal plane is measured by a first sensor 8 attached to the jib 3. The measured angle has a first angle value. A measuring device 9 measures the length of the unwound part of the luffing cable 5, from which length the minimum angle of the jib 3 with respect to the horizontal plane can be calculated. The calculated angle has a second angle value. The first angle value can thereby be compared with the second angle value.

The invention proves particularly advantageous if the measuring device has a second sensor which measures the rotation of the cable drum of the drawing-in unit during the unwinding and winding operations.

In a particularly advantageous embodiment of the invention, if a deviation between the two angle values is established during the unwinding of the luffing cable, the drive of the drawing-in unit is switched off.

In a further particularly advantageous embodiment of the invention, when the first angle value deviates from the second angle value, the luffing cable is wound up until the second angle value coincides with the first angle value. In this embodiment, it is possible to again eliminate a slack cable, which has already formed because wind presses the jib inward (upward), by the luffing cable being shortened to the length which corresponds to the actual jib angle. This prevents the jib from falling outward (downward) and being abruptly secured by the luffing cable when the wind drops. This prevents hazardous shaking.

The invention claimed is:

1. A luffing-jib tower crane, comprising:

a tower, a jib connected to the tower via a joint, and a luffing cable holding the jib, wherein a drawing-in unit is configured to adjust a length of the luffing cable by winding the luffing cable onto a cable drum of the drawing-in unit or unwinding the luffing cable from the cable drum, wherein an angle of the jib with respect to the horizontal plane is measured by a first sensor attached to the jib, the angle having a first angle value, wherein a measuring device measures a length of an unwound part of the luffing cable so as to calculate a minimum angle of the jib with respect to the horizontal plane based on the length of the unwound part of the luffing cable, the calculated angle having a second angle value, and wherein the measuring device facilitates comparison of the first angle value and the second angle value.

2. The luffing-jib tower crane as claimed in claim 1, wherein when the first angle value deviates from the second angle value, a drive of the drawing-in unit is switched off.

3. The luffing-jib tower crane as claimed in claim 1, wherein when the first angle value deviates from the second angle value, the luffing cable is wound up until the second angle value coincides with the first angle value.

4. The luffing-jib tower crane as claimed in claim 1, wherein the measuring device has a second sensor which measures rotation of the cable drum of the drawing-in unit during the unwinding and winding of the luffing cable.

5. The luffing-jib tower crane as claimed in claim 4, wherein when the first angle value deviates from the second angle value, a drive of the drawing-in unit is switched off.

6. The luffing-jib tower crane as claimed in claim 4, wherein when the first angle value deviates from the second angle value, the luffing cable is wound up until the second angle value coincides with the first angle value.

* * * * *